United States Patent [19]

Takahashi et al.

[11] Patent Number: 4,458,731

[45] Date of Patent: Jul. 10, 1984

[54] AIR DISTRIBUTOR CONSTRUCTION FOR AUXILIARY NOZZLES OF AIR JET LOOM

[75] Inventors: Takao Takahashi, Hachioji; Masayuki Koriyama, Tokyo; Kazunori Ishimoto, Koganei, all of Japan

[73] Assignee: Nissan Motor Company, Ltd., Yokohama, Japan

[21] Appl. No.: 420,841

[22] Filed: Sep. 21, 1982

[30] Foreign Application Priority Data

Oct. 2, 1981 [JP] Japan ..... 56-156130

[51] Int. Cl.[3] ..... D03D 47/30

[52] U.S. Cl. ..... 139/435

[58] Field of Search ..... 139/435, 437, 188; 226/97

[56] References Cited

U.S. PATENT DOCUMENTS 3,461,919 9/1969 Wueger ..... 139/437
4,290,460 9/1981 Deborde ..... 139/435

FOREIGN PATENT DOCUMENTS 188398 10/1975 Czechoslovakia .
195910 4/1976 Czechoslovakia .
201475 3/1979 Czechoslovakia .
179659 7/1979 Czechoslovakia .
181848 1/1980 Czechoslovakia .
214788 4/1981 Czechoslovakia .
191546 12/1981 Czechoslovakia .
195248 5/1982 Czechoslovakia .
2328135 8/1978 Fed. Rep. of Germany .
2401246 3/1979 France .
608086 12/1978 Switzerland .

*Primary Examiner*—Henry Jaudon
*Attorney, Agent, or Firm*—Schwartz, Jeffery, Schwaab, Mack, Blumenthal & Koch

[57] ABSTRACT

An air distributor construction for auxiliary nozzles of an air jet loom, comprises an air passage which extends along the direction of weft picking and communicates with all the auxiliary nozzles, the air passage being supplied with pressurized air. Additionally, a certain number of sealing members are detachably disposed at certain locations of the air passage to divide the air passage into a certain number of air distribution passages each of which communicates with each group of auxiliary nozzles, thereby constituting an independent air supply system for each group of auxiliary nozzles. Accordingly, the number of auxiliary nozzles corresponding to each air supply system becomes variable.

11 Claims, 9 Drawing Figures

AIR DISTRIBUTOR CONSTRUCTION FOR AUXILIARY NOZZLES OF AIR JET LOOM

BACKGROUND OF THE INVENTION

1. Field of the Invention

This invention relates to, an air jet loom of the type wherein a plurality of auxiliary nozzles are in parallel alignment with the direction of weft picking, an air distributor structure for distributing air into respective groups of auxiliary nozzles one of which group consists of a certain number of auxiliary nozzles.

2. Description of Prior Art

In connection with conventional weft picking devices of air jet looms, it is well known to achieve weft picking by successively blowing up a weft yarn injected from a main nozzle under the influence of air ejected from a plurality of auxiliary nozzles which are aligned at suitable intervals along a weft picking channel. In such devices, the auxiliary nozzles are divided into a plurality of groups, so that air ejection is carried out successively from the auxiliary nozzles of the group at the main nozzle side, in which each group of auxiliary nozzles eject air at the same timing. More specifically, the air ejection in each group of auxiliary nozzles are carried out so that the auxiliary nozzles eject air simultaneously immediately before the leading end of the weft yarn reaches the vicinity of the auxiliary nozzle located nearest the main nozzle in the group until immediately after the air ejection of the suceeding group of the auxiliary nozzles starts after the leading end of the weft yarn passes by the auxiliary nozzle located farthest from the main nozzle in the group.

In the thus arranged conventional devices, several auxiliary nozzles are installed at a relatively short block and accordingly all the auxiliary nozzles are installed at a plurality separate blocks. These blocks are suitably aligned in a groove of a reed holder in which the auxiliary nozzles installed at the same block belong to a single group, or otherwise two groups if necessary. Each group of auxiliary nozzles is arranged to eject, at the same timing, air which is supplied from an air distribution passage.

However, the thus arranged conventional devices have encountered the problems that, in order to optionally select the number of auxiliary nozzles in the same group according to the kinds of woven fabrics, it is necessary to prepare a block equipped with the required number of auxiliary nozzles, which requires too many blocks which are equipped with various numbers of auxiliary nozzles, thereby rendering much higher production cost.

For example, in the case where each block is equipped with eight auxiliary nozzles at the intervals of 50 mm to form a group of auxiliary nozzles, five groups of auxiliary nozzles are formed on the basis of a woven fabric width of 200 cm. However, although the auxiliary nozzles are thus grouped, the necessity may arise to divide all the auxiliary nozzles into four groups in order to weave a certain different kind of fabric. For this purpose, it becomes necessary to form one group with ten auxiliary nozzles. However, in practice, this is impossible because the auxiliary nozzles at each block are arranged to form one group of auxiliary nozzles. In order to enable this, it is necessary to additionally prepare other blocks each equippped with ten auxiliary nozzles.

SUMMARY OF THE INVENTION

In accordance with the present invention, an air jet loom is provided with an air distributor construction which distributes air into a plurality of auxiliary nozzles in parallel alignment along the direction of weft picking. The air distributor construction comprises an air passage which extends along the weft picking direction and communicates with all the auxiliary nozzles, the air passage being supplied with pressurized air. Additionally, a predetermined number of sealing members are detachably disposed at predetermined locations of the air passage to divide the air passage into a predetermined number of air distribution passages each of which communicates with each group of the auxiliary nozzles, thereby constituting an independent air supply system for each group of auxiliary nozzles. Accordingly, the number of auxiliary nozzles corresponding to each air supply system becomes variable. This enables changing the number of auxiliary nozzles corresponding to each group or air supply system, according to kinds of weft yarns, thereby rendering it unnecessary to prepare many blocks which are equipped with different numbers of auxiliary nozzles.

BRIEF DESCRIPTION OF THE DRAWINGS

The features and advantages of the air distributor construction according to the present invention will be more clearly appreciated from the following description taken in conjunction with the accompanying drawings in which like reference numerals designate corresponding parts and elements, and in which.

DETAILED DESCRIPTION OF THE INVENTION

Figure 1:
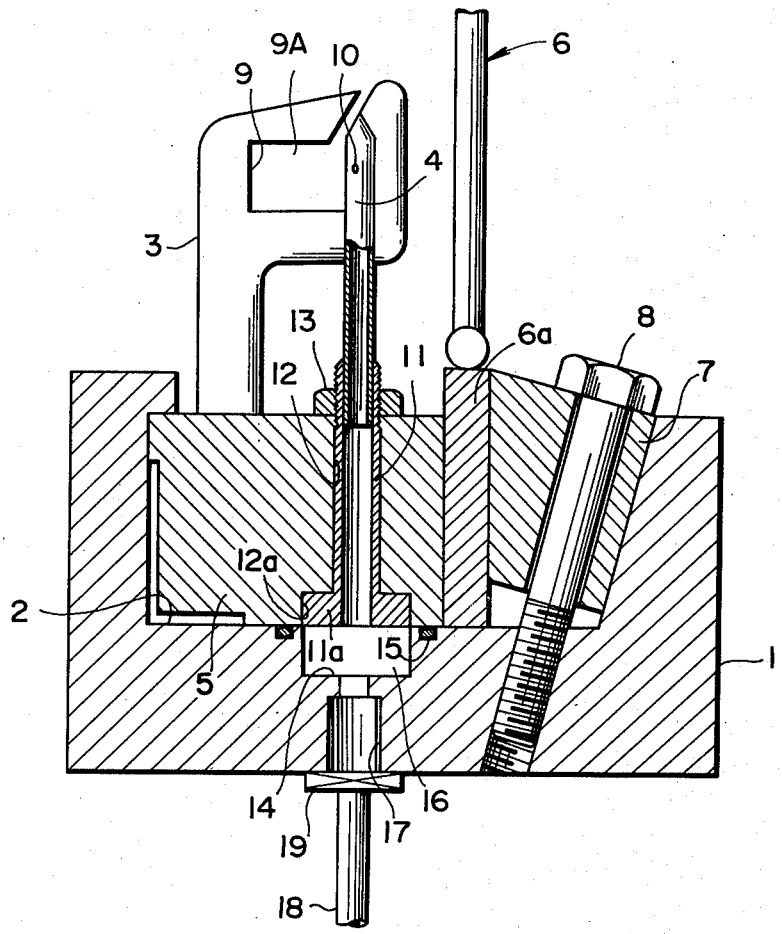
FIG. 1 is a sectional side elevation showing an embodiment of an air distributor construction in accordance with the present invention.
Figure 2:
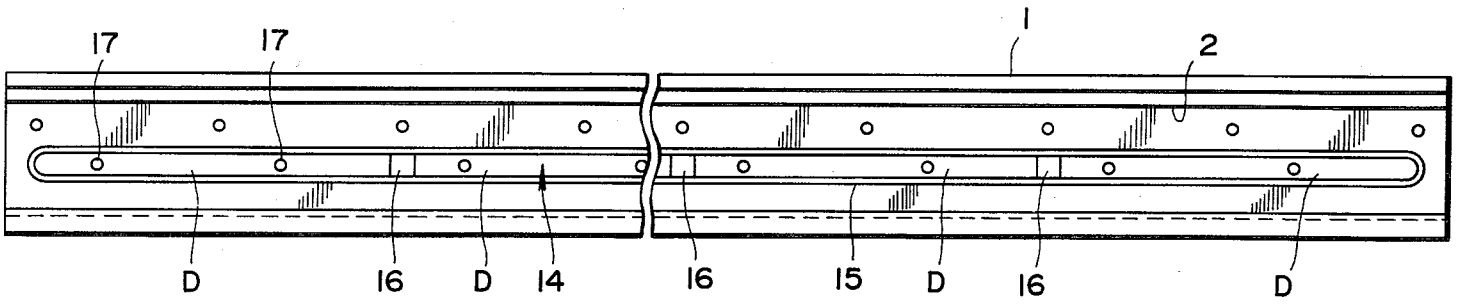
FIG. 2 is a plan view of a reed holder forming part of the construction of FIG. 1.

Referring now to FIGS. 1 and 2, there is shown a preferred embodiment of an air distributor construction of an air jet loom, in accordance with the present invention. The air jet loom is composed of a reed holder 1 which is formed with an installation groove 2 in which a block 5 and the lower frame 6*a* of a reed 6 are fixedly disposed. The block 5 is provided with a plurality of air guide members 3 which are aligned along the direction of weft picking in relatively close proximity to each other. Additionally, the block 5 is provided with a plurality of auxiliary nozzles 4 which are located at suitable intervals along the weft picking direction. The block 5 and the reed lower frame 6*a* are secured in position by thrusting a wedge member 7 in between the reed lower frame 6*a* and the side wall surface of the reed holder groove 2. The thrusting of the wedge member 7 is accomplished by screwing a bolt 8 connecting the wedge member 7 and the lower section of the reed holder 1.

Each air guide member 3 is formed with an air guide opening 9 which defines a weft guide channel or weft picking channel 9A through which a weft yarn (not shown) is picked. Each auxiliary nozzle 4 is formed with an auxiliary air ejection opening 10 through which auxiliary air is ejected in the weft guide channel 9A.

Each auxiliary nozzle 4 is securely held in a pipe-like holder 11 which is disposed in a holder installation opening 12 which vertically pierces the block 5. The installation opening 12 has a large diameter section 12*a* in which a lower large diameter section 11*a* of the holder 11 is disposed, which is accomplished by inserting upwardly the holder 11 into the installation opening 12 from the lower side of the opening 12. The holder 11 is formed at its upper part with a threaded portion which engages with a nut 13, so that the holder 11 is secured in position by tightening the nut 13.

The reed holder 1 is formed with an air passage groove 14 which forms part of the air distributor construction and located at the bottom surface of the groove 2. The air passage groove 14 is formed at the location corresponding to the holder installation openings 12 and extends in the direction of the length of the reed holder 1. Additionally, a seal ring 15 is disposed within a groove (no numeral) which is formed surrounding the air passage groove 14, thereby maintaining air-tight seal of the air passage groove 14.

A suitable number of dividing or sealing members 16 are detachably disposed or fitted respectively at suitable locations in the air passage groove 14 in order to divide the air passage groove 14 into a plurality of air distribution passages D. It will be understood that each air distribution passage D is defined between an end wall of the air passage groove 14 and the sealing member 16, or between the adjacent sealing members 16. Each sealing member 16 is formed into the shape corresponding to the cross-sectional shape of the air passage groove 14 and made of a resilient material such as soft rubber, so that the elasticity of the sealing member 16 fit tightly in the air passage groove 14 while maintaining an air-tight seal of each air distribution passage D.

A plurality of air introduction openings 17 are formed in the reed holder 1 and aligned along the air passage groove 14 at suitable intervals, and communicate with the air passage groove 14. Pipes 18 are connected through connectors 19 to the bottom surface of the reed holder in such a manner as to communicate respectively with air introduction openings 17. The pipes 18 are connected to a pressurized air supply source (not shown) respectively through valves ($V_1$ to $V_8$ in FIG. 3) which are operated respectively at predetermined timings and each of which forms part of an independent air supply system. Only one pipe 18 is communicable to supply pressurized air into the corresponding air distribution passage D, and accordingly the communication between the air distribution passage D and the other pipe communicable with the passage D is blocked by fully closing the air introduction opening 17 with a plug 20 (in FIG. 3) used in place of the connector 19.

The explanation of operation of the above-mentioned air distributor construction will be made with reference to FIG. 3 in which twenty-four auxiliary nozzles 4 (a-x) are used.

Figures 3, 3A, 3B, 3C:
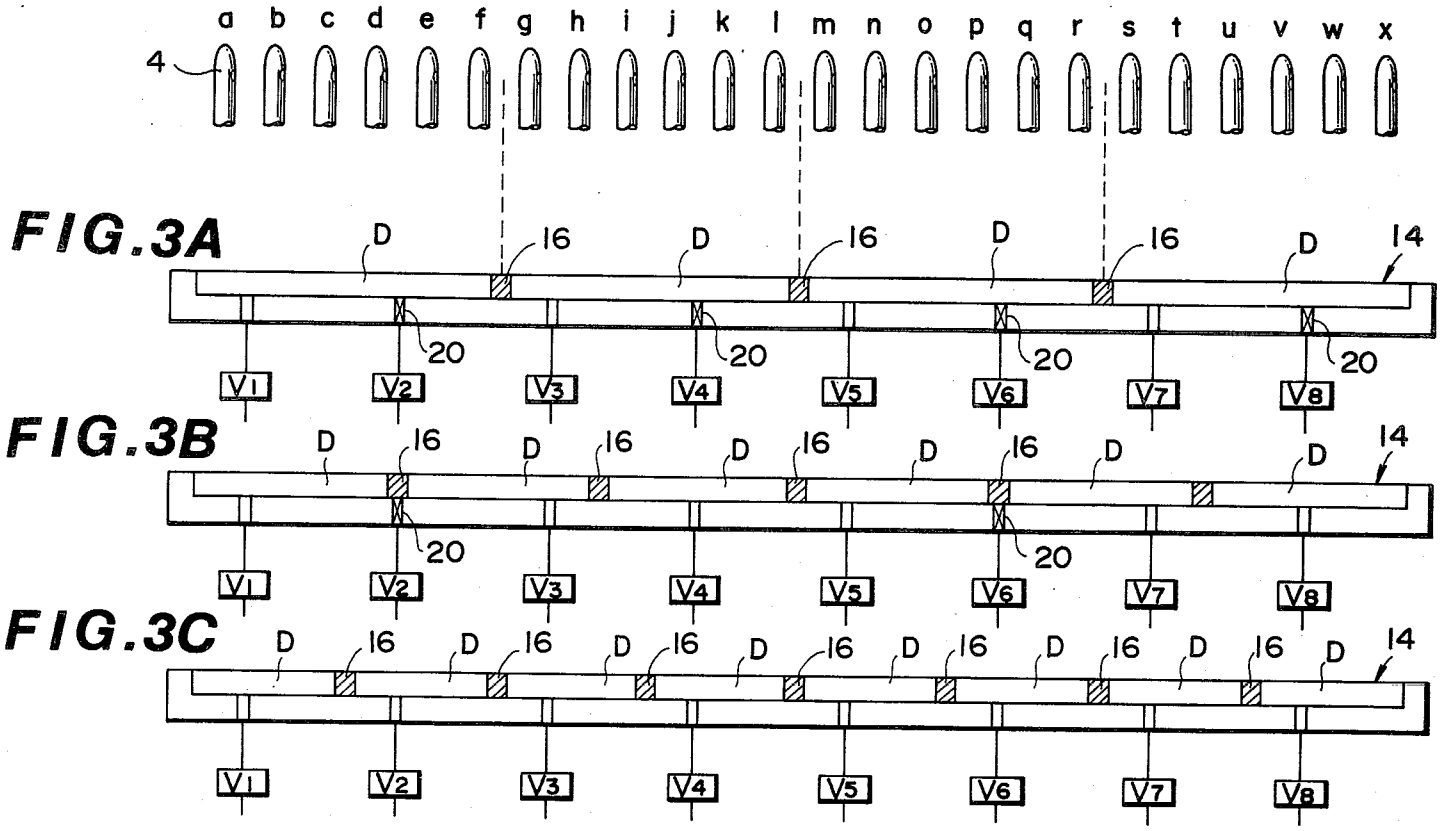
FIG. 3 (including FIGS. 3A, 3B and 3C) is a schematic illustration showing various modes of operation of the construction of FIG. 1.

In case of grouping the auxiliary nozzles into four group each consisting of six auxiliary nozzles as shown in FIG. 3A, three sealing members 16 are used to divide the air passage groove 14 into four air distribution passages D. Additionally, the four air distribution passages D are supplied with pressurized air respectively through the valves $V_1$, $V_3$, $V_5$ and $V_7$, in which the communication of the air distribution passages D and the valves $V_2$, $V_4$, $V_6$, and $V_8$ is blocked by means of the plugs 20 closing the air introduction openings 17. Otherwise, the plugs 20 may not be used in position so that the valves $V_2$, $V_4$, $V_6$ and $V_8$ are also operated in synchronism with the valves $V_1$, $V_3$, $V_5$, $V_7$, respectively in order to supply pressurized air into each air distribution passage D through two valves such as $V_1$ and $V_2$. Thus, pressurized air from the air supply source is introduced independently to each of four groups of auxiliary nozzles (a-f, g-1, m-r, and s-x).

In an embodiment where the auxiliary nozzles 4 comprise six groups each consisting of four auxiliary nozzles 4 as shown in FIG. 3B, five sealing members 16 are used to divide the air passage groove 14 into six air distribution passages D. Additionally, the six air distribution passages D are supplied with pressurized air respectively through the valves $V_1$, $V_3$, $V_4$, $V_5$, $V_7$ and $V_8$, in which the communication of the air distribution passages D with the valves $V_2$ and $V_6$ is blocked by means of the plugs 20 closing the air introduction openings 17. Thus, pressurized air from the air supply source is introduced independently to each of six groups of auxiliary nozzles (a-d, e-h, i-l, m-p, q-t, and u-x).

In an embodiment where the auxiliary nozzles 4 comprise eight groups each consisting of three auxiliary nozzles 4 as shown in FIG. 3C, seven sealing members are used to divide the air passage groove 14 into eight air distribution passages D. Additionally, the eight air distribution passages D are supplied with pressurized air respectively through the valves $V_1$, $V_2$, $V_3$, $V_4$, $V_5$, $V_6$, $V_7$ and $V_8$. Thus, pressurized air is supplied independently to each of the eight groups of auxiliary nozzles (a-c, d-e, g-i, j-l, m-o, p-r, s-u, and v-x).

The relationship between the grouped auxiliary nozzles and the corresponding valves in the above-mentioned three cases will be clearly shown in Table 1.

TABLE 1

| | Items | | | |
|---|---|---|---|---|
| Cases | Groups | Auxiliary Nozzles | A. Nozzle Number | Used Valves |
| FIG. 3A case | 1 | a, b, c, d, e, f | 6 | $V_1$ ($V_2$) |
| | 2 | g, h, i, j, k, l | " | $V_3$ ($V_4$) |
| | 3 | m, n, o, p, q, r | " | $V_5$ ($V_6$) |
| | 4 | s, t, u, v, w, x | " | $V_7$ ($V_8$) |
| FIG. 3B case | 1 | a, b, c, d | 4 | $V_1$ |
| | 2 | e, f, g, h | " | $V_3$ |
| | 3 | i, j, k, l | " | $V_4$ |
| | 4 | m, n, o, p | " | $V_5$ |
| | 5 | q, r, s, t | " | $V_7$ |
| | 6 | u, v, w, x | " | $V_8$ |
| FIG. 3C case | 1 | a, b, c | 3 | $V_1$ |
| | 2 | d, e, f | " | $V_2$ |
| | 3 | g, h, i | " | $V_3$ |
| | 4 | j, k, l | " | $V_4$ |
| | 5 | m, n, o | " | $V_5$ |
| | 6 | p, q, r | " | $V_6$ |
| | 7 | s, t, u | " | $V_7$ |
| | 8 | v, w, x | " | $V_8$ |

While it has been shown and described in the above-mentioned embodiment, that each of a plurality of auxiliary nozzle groups consists of the same number of auxiliary nozzles, it will be understood that the number of respective groups may be different from each other, and additionally the installation intervals of the auxiliary nozzles may be different from each other.

Figure 4:
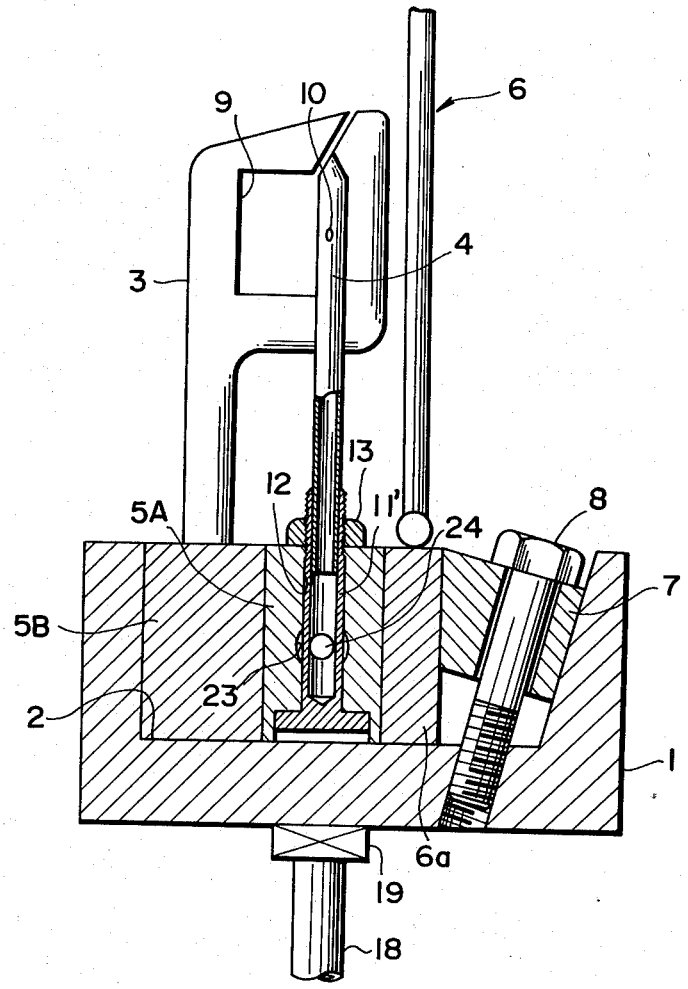
FIG. 4 is a sectional side elevation showing another embodiment of the air distributor construction in accordance with the present invention.
Figure 5:
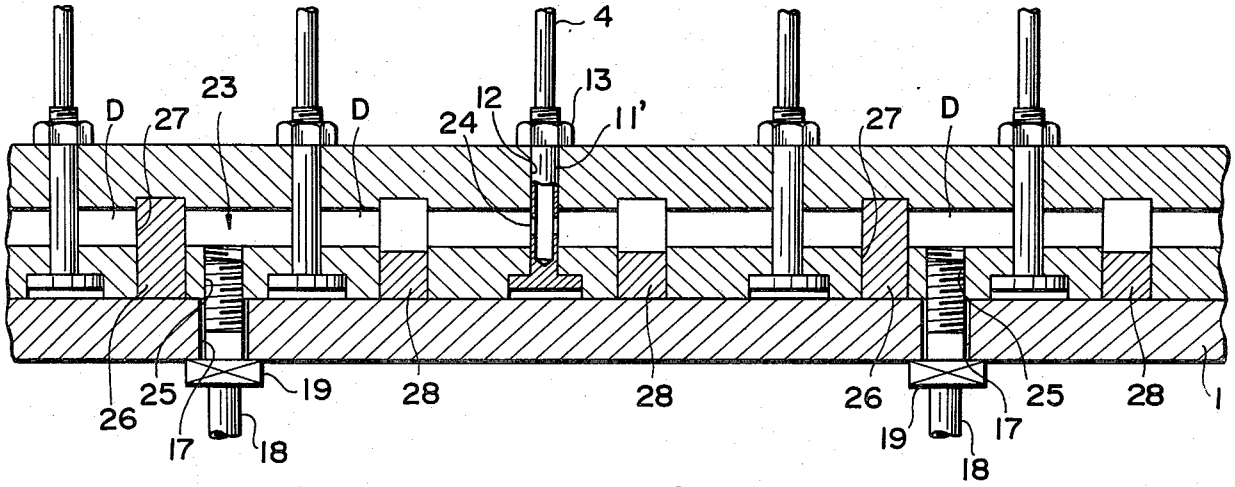
FIG. 5 is a sectional front elevation of the construction of FIG. 4.
Figure 6:
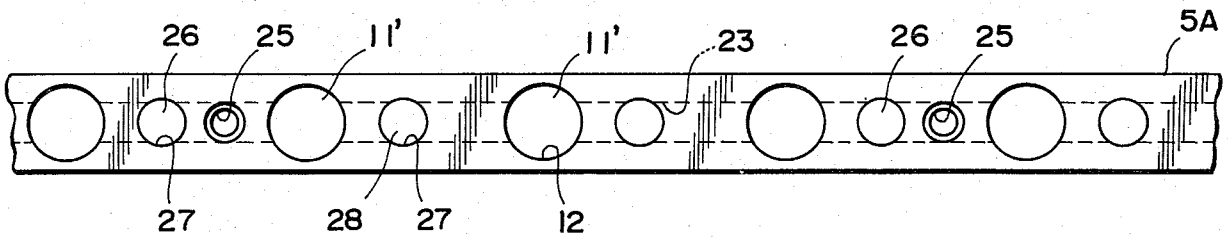
FIG. 6 is a bottom plan view of a block equipped with auxiliary nozzles, of the construction of FIG. 4.

FIGS. 4 to 6 illustrate another embodiment of the air distributor construction in accordance with the present invention, in which a block 5A provided with the auxiliary nozzles 4 and another block 5B provided with the air guide members 3 are formed independent from each other. As shown, the block 5A is formed with an air passage opening 23 which extends along the length of the block 5A and intersects the holder installation openings 12 so that the air passage opening 23 merges into the holder installation opening 12. In this embodiment, each auxiliary nozzle holder 11' is closed at its bottom, and comprises at its side wall a communication opening 24 whose location corresponds to the location of the air passage opening 23 so that both the openings 23 and 24 are in communication with each other to introduce pressurized air from the air passage opening 23 to the communication opening 24. Additionally, the block 5A is further formed with a plurality of vertical holes each of which extends from the suitable portions of the air passage opening 23 to the bottom surface of the block 5A. Each vertical hole 25 communicates with the air introduction opening 17 to which the pipe 18 communicates through the connector 19. The pipe 18, in turn, communicates through the valve (not shown) with the pressurized air supply source (not shown). Accordingly, pressurized air is supplied to the air passage opening 23. The block 5A is formed with a plurality of holes 27 each of which extends from the air passage opening 23 to the bottom surface of the block 5A. A blocking or sealing member 26 is detachably fitted or disposed within the hole 27 and extends upwardly to block the air passage opening 23. If the air passage opening 23 does not need to be blocked at the locations corresponding to certain holes 27, these holes 27 are filled with plugs 28 which do not extend into the air passage opening 23. Accordingly, the sealing members 26 divide the air passage opening 23 into a plurality of the air distribution passages D to one of which each group of auxiliary nozzles 4 communicates.

It will be understood that the number of the auxiliary nozzles belonging to each auxiliary nozzle group is variable by selectively using the sealing members 26 and the plugs 28.

In the case where the air guide members 3 and the auxiliary nozzles 4 are installed at the same block, it is usual that a plurality of relatively shortly divided blocks are connected side by side. Although it may be that air leaking occurs at the locations where the neighboring shortly divided blocks are connected with each other, this problem can be solved by sticking a sheet or film type sealing member (not shown) made of resilient material such as soft rubber, on the end portions of each shortly divided block. In such a case the shortly divided blocks are assembled in the reed holder under the condition where the end faces of the neighbouring shortly divided blocks are kept in urgingly contact with each other.

As will be appreciated from the above, according to the present invention, it can be possible to vary the number of the auxiliary nozzles belonging to each auxiliary nozzle group whose auxiliary nozzles eject auxiliary air in the same manner, without preparing many blocks which are provided with different numbers of auxiliary nozzles. Accordingly, an auxiliary nozzle arrangement suitable for kinds (material, diameter etc.) of weft yarns can be easily obtained, thereby improving weft picking operation while contributing to operation cost saving.

What is claimed is:

1. An air distributor construction of an air jet loom, for distributing air to a plurality of groups of auxiliary nozzles in parallel alignment with the direction of weft picking, said construction comprising:

means defining an air passage which extends along the weft picking direction and communicates with all the auxiliary nozzles, said air passage being supplied with pressurized air; and a predetermined number of sealing members detachably disposed at predetermined locations of said air passage to divide said air passage into a predetermined number of air distribution passages each of which communicates with a respective one of the groups of auxiliary nozzles, thereby constituting an independent air supply system for each group of auxiliary nozzles, whereby the number of auxiliary nozzles corresponding to each air supply system is variable.

2. An air distributor construction as claimed in claim 1, further comprising a plurality of valves through each of which a respective air distribution passage is communicable with a pressurized air supply source.

3. An air distributor construction as claimed in claim 1, wherein said sealing members are so formed as to maintain air-tight seal of said air distribution passages.

4. An air distributor construction as claimed in claim 3, wherein each sealing member is made of resilient material.

5. An air distributor construction as claimed in claim 4, wherein said resilient material is soft rubber.

6. An air distributor construction as claimed in claim 1, wherein said air passage is formed in a structure on which a reed is mounted, said structure including a reed holder formed with a first groove which extends along the length of said reed holder, and a block securely disposed within said first groove, said block being provided with auxiliary nozzles.

7. An air distributor construction as claimed in claim 6, wherein said air passage is formed at a part of said reed holder and communicates with said auxiliary nozzles through an opening piercing said block.

8. An air distributor construction as claimed in claim 7, wherein said air passage is a second groove merging in said first groove.

9. An air distributor construction as claimed in claim 8, wherein each sealing member is detachably disposed within said second groove so that the location of each sealing member is changeable.

10. An air distributor construction as claimed in claim 6, wherein said air passage is formed at a part of said block and communicates with the auxiliary nozzles.

11. An air distributor construction as claimed in claim 10, wherein said block is formed with a plurality of holes extending from said air passage to the outer surface of said block, in which each sealing member is selectively insertable into one of said plurality of holes and projected into said air passage to maintain air-tight seal of each air distribution passage.

* * * * *